United States Patent [19]

Dietz et al.

[11] 4,360,734

[45] Nov. 23, 1982

[54] METHOD AND APPARATUS FOR THE OPERATION OF ROTARY ANODE X-RAY TUBES

[75] Inventors: Kurt Dietz, Erlangen; Rudolf Friedel, Kleinseebach, both of Fed. Rep. of Germany

[73] Assignee: Siemens Aktiengesellschaft, Berlin & Munich, Fed. Rep. of Germany

[21] Appl. No.: 254,060

[22] Filed: Apr. 14, 1981

[30] Foreign Application Priority Data

Apr. 28, 1980 [DE] Fed. Rep. of Germany ..... 3016376

[51] Int. Cl.[3] ..... H05G 1/66; H01J 35/10

[52] U.S. Cl. ..... 378/93; 378/114

[58] Field of Search ..... 250/406

[56] References Cited

U.S. PATENT DOCUMENTS 2,149,164 2/1939 Daumann ..... 250/406
4,024,424 5/1977 Eggelsmann et al. .
4,107,535 8/1978 Kotabe et al. ..... 250/406

FOREIGN PATENT DOCUMENTS 929142 6/1955 Fed. Rep. of Germany .

*Primary Examiner*—Eugene La Roche
*Assistant Examiner*—T. N. Grigsby
*Attorney, Agent, or Firm*—Hill, Van Santen, Steadman, Chiara & Simpson

[57] ABSTRACT

In an exemplary embodiment, a portion of the tube vacuum envelope is disposed between the rotor and stator of the anode drive motor. Taking into account the required high voltage safety, hitherto concessions as to the anode drive had to be made. The disclosure provides an improvement in this regard in that the anode and stator are connected to the same potential until a desired rotational frequency is attained. Only then, subsequent to disconnection of the drive voltage, is the radiography voltage applied for the necessary exposure period. If necessary, subsequently a braking voltage, or again a drive voltage, respectively, can be applied to the stator. Methods and installations in which, in accordance with the disclosure, the drive of the rotary anode is intensified, are, in particular, suited for utilization in medical x-ray diagnostics, mainly computer tomography.

6 Claims, 2 Drawing Figures

METHOD AND APPARATUS FOR THE OPERATION OF ROTARY ANODE X-RAY TUBES

BACKGROUND OF THE INVENTION

The invention relates to a method and apparatus for the operation of rotary anode x-ray tubes. A method of this type and an apparatus for its realization are e.g. described in the German OS No. 2,455,974.

In the case of rotary anode x-ray tubes, the anode, together with the rotor connected with it via the drive shaft, is supplied with a high voltage potential. The stator, resting externally against the tube, is normally at ground potential, since otherwise, as in the case of an embodiment according to U.S. Pat. No. 4,107,535, the drive voltage would have to be supplied via a high voltage transformer and high voltage cable. The problem is only that a high voltage insulation must be carried out between the rotor of the anode and the stator. This is particularly problematical, on account of the large air gap brought about thereby, when high operating voltages (e.g. 150 kV) are to be connected in unipolar fashion to cathode-side grounded tubes, such as e.g. expedient in the case of grid-controlled tubes on account of the simple controllability of the cathodes.

A known solution is disclosed in the above cited German OS No. 2,455,974. It consists in that the rotor of the anode assembly is insulated relative to the anode itself within the tube, and that said rotor in operation carries approximately the same potential as the stator, preferably ground potential. However, this only shifts the insulation problems into the tube interior and therefore requires complicated and expensive tube constructions.

During operation of a rotary anode x-ray tube, the fluctuating magnetic field of the rotary anode induction motor causes a disturbance of the electron beam which results in a migration back and forth of the focal spot on the anode in synchronism with the magnetic field fluctuations. In order to avoid these fluctuations, which bring about an undesired effective expansion of the focal spot, accordingly, in accordance with the German LP No. 929,142, for a diagnostic x-ray apparatus with a rotary anode, switching means coupled with the switching-on means for switching-on the x-ray tube, have been proposed, which switching means, immediately prior to the radiograph, respectively, effect a disconnection of the current supply to the stator of the rotary anode motor previously brought to the prescribed rotational rate.

BACKGROUND OF THE INVENTION

The invention has the objective of disclosing a method for the operation of rotary anode x-ray tubes according to the preamable of claim 1, and installations for its realization, in which at least essentially the conventional rotary anode construction can be employed, and yet an improvement in the operation is achieved. This object is achieved in accordance with the invention by the measures disclosed in the characterizing portion of claim 1.

The drive of the rotary anode assembly prior to application of the tube voltage and with the same potential of rotor and stator has the advantage that the design of the drive elements and their arrangement can proceed by taking into more consideration the requirements of the drive, without needing to take into account the high voltage safety. Only when the desired rotational frequency has been attained in the tube voltage applied, whereby the anode assembly, due to its inertia, continues to run virtually unchanged (at the speed attained during the application of driving power) while the radiograph is being carried out. Subsequently, in case an additional radiograph is to take place, the anode can again be brought to full rotational frequency or, upon termination of the use of the tube, a braking voltage can be applied to the stator, so that the anode is stopped in the conventional fashion.

In order to realize the inventive method, the stator is expediently connected to anode potential. The drive voltage is always connected to ground potential and is supplied to the stator via a high voltage switch (oil circuit breaker). After the anode has attained its rotational frequency and before the high voltage, for the purpose of radiography, is connected to the tube, the drive voltage is separated from the stator via the oil circuit breaker. The anode then continues to rotate without the application of driving power during radiography due to its inertia, with a virtually unaltered frequency until the radiography is terminated. Finally, subsequent to disconnection of the radiography voltage, a braking voltage can be applied via the oil circuit breaker and the anode can be stopped for the purpose of protecting the bearings. The oil circuit breaker can be housed in the high voltage transformer of the x-ray apparatus; however, on account of the then necessary supply of the drive voltage via a high voltage cable, it is advantageous to house the circuit breaker in the tube protective housing.

In accordance with the invention, as in the case of the above-cited reference, a narrow air gap between stator and rotor can be realized. This yields, as in the case of the reference cited in the introduction to the specification, shorter start-up times; i.e., it is possible, on account of the improved efficiency, to advantageously employ a starting apparatus which is weaker in power or a smaller rotor. However, in comparison with the prior-known solution, the significant advantage is achieved that a simple and more economical anode construction, which is free of insulation problems, is possible. In order to achieve as small as possible an air gap, the tube envelope in the region of the rotor, as in the cited reference, can advantageously consist of metal.

Further details and advantages shall be explained in greater detail in the following on the basis of exemplary embodiments of the invention illustrated in the Figures of the accompanying drawing sheet; and other objects, features and advantages will be apparent from this detailed disclosure and from the appended claims.

DETAILED DESCRIPTION

Figure 1:
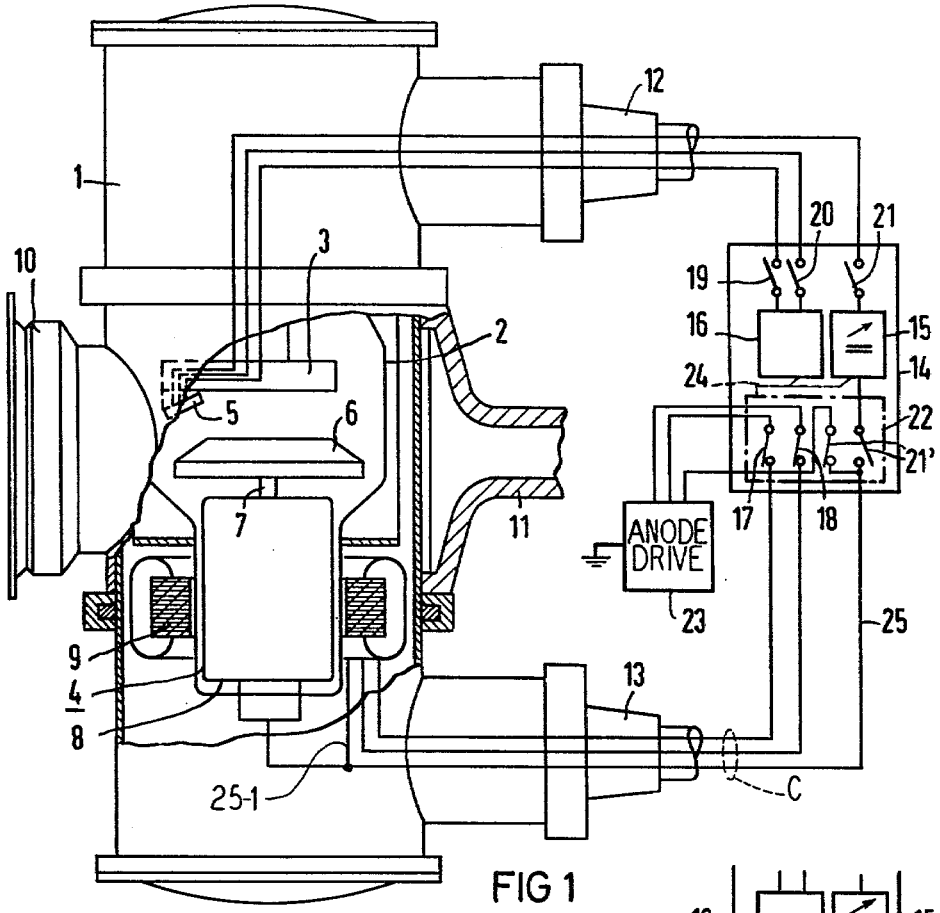
In FIG. 1 an illustration for carrying out the inventive method is illustrated; and In FIG. 2 a modified arrangement of the switching elements is illustrated.

In FIG. 1, in a tube cover 1 (illustrated partially broken away), a rotary anode x-ray tube 2 is housed. The tube 2 exhibits, in a known fashion, a cathode arrangement 3 and an anode arrangement 4 at mutually opposite interior regions of the cylindrical tube. The arrangement 3, in a manner known per se, contains a thermionic cathode 5 which consists of two separately switchable parts. At one axial end of the anode arrangement 4 there is disposed an anode plate 6 opposite the cathode 5 so that electron beams emanating from the cathode 5 impinge on a focal spot path of the anode plate 6. The anode plate 6 is connected via a shaft 7 with a rotor 8, serving, in a known fashion, for the rotary drive of the anode plate 6.

A stator 9 is associated with the rotor 8 externally on the tube 2. The tube cover 1 exhibits, on the side facing the beam exit of the tube 2, a beam exit tube 10. The entire cover 1 is mounted via a support arm 11, in a known fashion, on an x-ray apparatus, etc.

The supply of the operating voltages proceeds via connections 12 and 13. The lines come from a power supply apparatus 14, schematically illustrated in the form of a box. It contains a high voltage d.c. current source 15 with switches 21 and 21', as well as filament supply transformers 16 for the supply of the cathode 15, with switches 19 and 20.

For controlling the drive of the rotary anode plate 6 via rotor 8 and stator 9, and via switches 17, 18 and the switch 21', a starting apparatus 23 lying outside the housing for apparatus 14 is provided. The stator lines are supplied to the stator 9 via an anode-side high voltage cable indicated at C in FIG. 1 which includes a conductor 25 effecting the connection of the d.c. current source 15 with the anode arrangement 4. A switching installation 22 is shown as being contained within the housing of power supply 14. The installation 22 provides switches 17, 18 and 21'.

In the position of installation 22 illustrated in FIG. 1, the switches 17, 18 and 21' are closed to supply driving power to the anode assembly 4. In this manner, current is supplied to the stator 9, and the anode plate 6 is set in rotation. Upon attaining the desired rotational frequency, the switches 17, 18 and 21' are opened, and, upon closing of the switches 19 and/or 20, a part of the cathode 5, or both parts, respectively, are excited for the emission of electrons. Through the subsequent closing of the switches 21 and 21', high voltage is connected between the cathode 5 and the anode plate 6. This effects an acceleration of the electrons, issuing from the cathode 5, in the direction of the anode. Through decelerating impact of these electrons at the focal spot path of the anode, in a known fashion, x-ray beams are generated. Upon disconnection of the tube, the sequence of the switching operations is inversed and finally, if necessary, a braking potential is supplied to the stator 9 by means of the switches 17, 18 and 21'.

The synchronization of the actuation of the switches 17, 18 and 21' with those of the switches 20 and 21 is indicated by a broken line 24.

Figure 2:
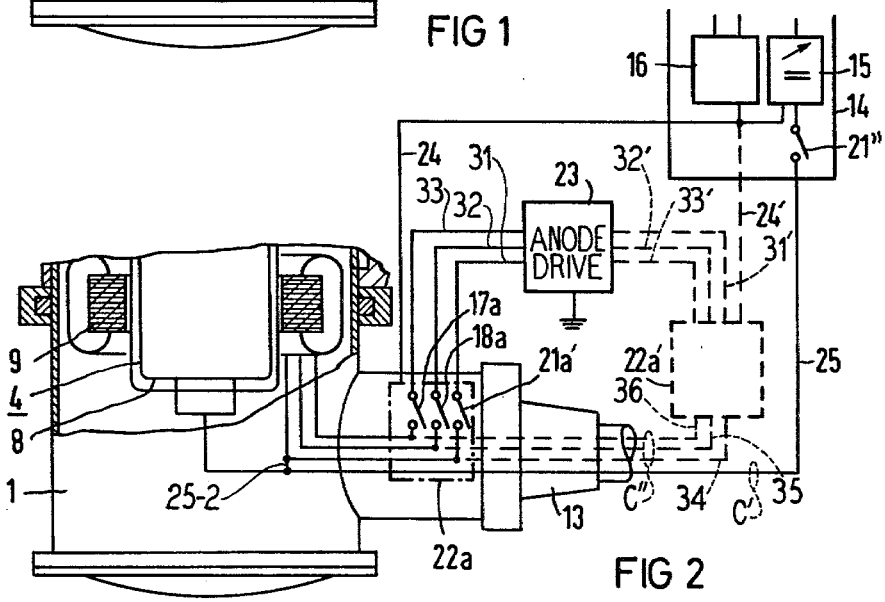

The arrangement of the switches 17, 18 and 21' can be modified according to FIG. 2 in that these switches are removed from the apparatus 14. This then provides an independent switching installation **22*a* or 22*a'* with switches 17*a*, 18*a* and 21*a'*. The switches 17*a*, 18*a*, 21*a* can then, for example for the purpose of retrofitting, be mounted at any suitable location of the x-ray apparatus, as indicated, either at 22*a* within the tube cover 1 or at 22*a'* outside it. The stator drive conductors are then guided, independently of the high voltage cable C' containing conductor 25, from the starting apparatus 23 to the switch arrangement 22*a* or 22*a'* and from there to the stator 9. The actual switching operation corresponds to that in the case of the actuation of the arrangement according to FIG. 1**.

Only through the separation of the second function of the switch 21' according to FIG. 1 to a switch **21*a'*, does a minor modification result. It consists in that, for the running of the rotor 8, the switching-on of the stator 9 proceeds via the switches 17*a*, 18*a* and 21*a'*. The switch 21' serves, in the case of the design according to FIG. 2**, only the purpose of switching-on the high voltage at the anode.

It will be apparent that many modifications and variations may be effected without departing from the scope of the novel concepts and teachings of the present invention.

SUPPLEMENTARY DISCUSSION

The anode drive 23 may take the form of a single phase alternating current source, and a starting circuit such as shown in German Pat. No. 929,142. According to the teachings of the present invention, no high voltage insulation transformer is required for the anode drive since the switches such as **17*a*, 18*a*, 21*a'*, FIG. 2, are opened prior to the connection of the source 15 to the rotor 8 and anode plate 6 via conductor 25 of high voltage cable C'. As indicated at 25-1 in FIG. 1 and at 25-2 in FIG. 2, the high voltage conductor 25 may be connected with the common point of the main and auxiliary stator windings of stator 9 so that both windings are at anode potential during each actual x-ray exposure. Because of the provision of the oil circuit breaker 22*a*, when switch contact 21*a'* is open, it is possible to have ground potential applied to conductor 31 from anode drive 23, while source 15 is applying anode potential relative to ground to conductor 25. Conductor 32 may connect with the other terminal of the main stator winding and conductor 33** may connect with the other terminal of the auxiliary stator winding.

Similarly, with the oil circuit breaker at **22*a'* outside the casing 1 of the x-ray tube, the anode drive 23 may have conductor 31' leading to the common terminal of the stator main and auxiliary windings and conductors 32' and 33' leading to the other winding terminals via respective contacts (corresponding to contacts 21*a'*, 18*a* and 17*a*, respectively) of the oil circuit breaker. The synchronizing coupling 24' prevents the application of anode voltage from anode voltage source 15 to the conductor 25 while the contacts of the oil circuit breaker 22*a'* are closed, and prevents the closure of the oil circuit breaker contacts when the source 15 is connected with conductor 25. Because of the connection 25-2, the conductors 34, 35, 36** would be housed in a high voltage cable C''.

Where the oil circuit breaker **22*a'* is located in the housing 14 with the high voltage transformer and rectifier of source 15**, the high voltage cables C'' and C' may be combined into a single high voltage cable.

We claim as our invention:

1. A method for the operation of a rotary anode x-ray tube whose anode is driven by means of a motor, between the rotor and stator of which the wall of the tube envelope is disposed, whereby, pursuant to application of a drive voltage to the stator, the rotor is brought to the desired rotational frequency, and that then, subsequent to disconnection of the drive voltage from the stator, the tube voltage, necessary for beam generation, is applied between the anode and cathode, said method further comprising connecting the rotor (8) and the stator (9) substantially to anode potential during the application of the anode voltage to the anode.

2. A method according to claim 1, characterized in that, subsequent to termination of the beam generation (e.g. radiography) period, the tube voltage is disconnected and a brake voltage, or repeatedly a drive voltage, respectively, is made effective between the rotor (8) and stator (9).

3. An apparatus for carrying out the method according to claim 1, characterized in that first and second switch means (17 through 21, 17*a*, 18*a*, 21', 21*a*') are provided for controlling supply of the drive voltage and for controlling supply of the radiography voltage, said first and second switch means having a synchronization coupling (24) blocking the simultaneous closure of both of said switch means.

4. An apparatus according to claim 3, with an x-ray tube having a tube cover (1), characterized in that the first switch means (17*a*, 18*a*, and 21*a*') for controlling the supply of the drive voltage are arranged inside the tube cover (1).

5. Apparatus according to claim 3, characterized in that a switching installation (22, 22*a*, 22*a*') contains the first switch means (17, 18 and 21' or 17*a*, 18*a* and 21*a*', respectively) for controlling the application of the drive voltage.

6. Apparatus according to claim 5, with an anode drive (23) controlling supply of drive voltage, and a high voltage cable (25) for supplying anode voltage to the anode, characterized in that the switching installation (22*a*, 22*a*') is arranged at a suitable location of the apparatus, with lines between the anode drive (23) and the switching installation (22*a*, 22*a*') and between the latter and the rotor (8) being laid independently of the high voltage cable (25).

* * * * *